US006769553B1

(12) United States Patent
Hurt

(10) Patent No.: US 6,769,553 B1
(45) Date of Patent: Aug. 3, 2004

(54) WALL-MOUNTABLE STORAGE DEVICE FOR RETAINING OBJECTS IN A COMPACT SPACE

(75) Inventor: Daniel P. Hurt, Spring Park, MN (US)

(73) Assignee: Legacy Holdings, Inc., Watertown, MN (US)

( * ) Notice: Subject to any disclaimer, the term of this patent is extended or adjusted under 35 U.S.C. 154(b) by 0 days.

(21) Appl. No.: 10/136,791

(22) Filed: Apr. 30, 2002

(51) Int. Cl.[7] ..... A47F 7/00
(52) U.S. Cl. ..... 211/70.6; 211/60.1
(58) Field of Search ..... 211/70.6, 106, 211/106.1, 65, 66, 94.01, 94.02, 87.01, 59.1; 248/73, 309.1

(56) References Cited

U.S. PATENT DOCUMENTS 2,805,777 A * 9/1957 Larson ..... 211/70.1
3,269,550 A * 8/1966 Marcus ..... 211/70.6
3,737,131 A * 6/1973 Larson ..... 248/200.41
4,681,233 A * 7/1987 Roth ..... 211/70.6
5,097,968 A * 3/1992 Gregory ..... 211/94.01
5,224,609 A * 7/1993 Bauer et al. ..... 211/65
5,513,758 A * 5/1996 Lin ..... 211/70.6
5,687,856 A * 11/1997 Kendrena ..... 211/70.6
5,711,435 A * 1/1998 Morison et al. ..... 211/90.01
5,740,927 A * 4/1998 Yemini ..... 211/70.6
5,743,416 A * 4/1998 Yemini ..... 211/70.6
5,979,675 A * 11/1999 Moriarty ..... 211/60.1
6,349,827 B1 * 2/2002 Feder ..... 206/373
6,481,583 B1 * 11/2002 Black et al. ..... 211/70.6
6,488,151 B2 * 12/2002 Ramsey et al. ..... 206/378
6,571,966 B1 * 6/2003 Hsiao ..... 211/70.6
6,626,402 B1 * 9/2003 Kaminstein ..... 248/110
2001/0003331 A1 * 6/2001 Heneveld ..... 211/70.6

* cited by examiner

*Primary Examiner*—Jennifer E. Novosad
(74) *Attorney, Agent, or Firm*—Haugen Law Firm PLLP

(57) ABSTRACT

A storage device for storing and organizing various articles adjacent to upstanding walls includes a frame having mounting apertures disposed therein for operably receiving mounting fasteners therethrough so as to removably attach the frame to an upstanding surface. The storage device further includes a plurality of storage apertures disposed therein, which apertures are specifically sized and configured to receive handled implements therethrough.

1 Claim, 4 Drawing Sheets

10
12
14
16
18
22
23
24
26
27
28
29
32
38

WALL-MOUNTABLE STORAGE DEVICE FOR RETAINING OBJECTS IN A COMPACT SPACE

FIELD OF THE INVENTION

The present invention relates to storage devices generally, and more particularly to devices for storing and organizing various items adjacent to walls.

BACKGROUND OF THE INVENTION

A number of storage/organizing devices have been developed to provide storing means for various objects. Such devices include modular shelving units, rotatable racks, and drawer systems, among several others. Such devices, however, are limited in their applicability by their geometrical configurations, and their lack for adaptability to efficient mounting arrangements. In addition, typical storage devices in use today do not have the capability of storing a variety of objects including handled implements in a compact space.

Therefore: it is therefore a principle object of the present invention to provide a device for efficiently storing various articles in a compact space, such as adjacent to upstanding walls.

It is a further object of the present invention to provide a device for storing various articles including handled implements in spaces adjacent to, and surrounding exposed wall studs.

It is a still further object of the present invention to provide a wall-mountable device for storing various articles in compact spaces.

SUMMARY OF THE INVENTION

By means of the present invention, utilization of space, such as adjacent to upstanding walls, is improved by providing a storage device that is adaptable to such spaces. The storage device of the present invention is preferably configured to abut adjacent walls, and is preferably configured to store articles of various sizes and shapes. A particular embodiment of the storage device of the present invention includes an elongated frame having a first side and a generally opposing second side, the frame including mounting apertures disposed therein for operably receiving mounting fasteners therethrough for removably attaching the frame to an upstanding surface. In addition, the storage device includes a plurality of storage protrusions extending outwardly from the first side of the frame, wherein the protrusions have a generally flat upper surface and opposing side surfaces depending downwardly therefrom. The upper surfaces of the storage protrusions include one or more storage apertures disposed therein, which apertures are specifically sized and configured to operably receive handled implements therethrough. Preferably, the storage device includes tabs extending upwardly from respective distal ends of the storage protrusions. In addition, the storage apertures are preferably variously configured for receiving various handled implements therethrough.

In another embodiment of the present invention, the storage device includes a frame having a first side wall and a generally opposed second side wall, and first and second end walls disposed between respective distal ends of the first and second side walls. The side walls and the end walls extend upwardly from a generally planar support surface such that the side walls, end walls, and support surface, in combination, define a storage enclosure. The first side wall includes mounting apertures disposed therein for operably receiving mounting fasteners therethrough for removably attaching the frame to an upstanding surface. In addition, a plurality of storage apertures are disposed in the support surface, wherein the apertures are specifically sized and configured to receive handled implements therethrough. Preferably, the storage device includes hook tabs extending outwardly from an outer surface of the second side wall. Further, the storage device preferably includes storage slots extending vertically through the second side wall, wherein the slots are configured to receive relatively narrow handled implements.

A further embodiment of the present invention includes a storage device having a frame having a mounting wall including a first end portion, a second end portion, and a recessed portion disposed therebetween. The recessed portion has a first side extending substantially perpendicularly from a proximal end of the first end portion, a second side extending substantially perpendicularly from a proximal end of the second end portion, and a third side extending between respective distal ends of the first and second sides of the recessed portion. In such a manner, the recessed portion forms a substantially U-shaped structure between the first and second end portions. The recessed portion has mounting apertures disposed therein for operably receiving mounting fasteners therethrough for removably attaching the frame to an upstanding surface. The frame includes an outer wall extending outwardly from, and connecting respective distal ends of, the first and second end portions. The storage device include a generally planar support surface extending between respective lower edges of the mounting walls and the outer wall, such that the mounting walls, the outer wall, and the support surface, in combination define an open-top enclosure. The support surface includes a plurality of storage apertures disposed therein, which apertures are specifically sized and configured to receive handled implements therethrough.

Preferably, the first and second end portions include mounting apertures disposed therein. The recessed portion is preferably specifically sized and configured to receive an upstanding wall stud therein. In such an embodiment, the recessed portion is about 1.5 inches wide and between about 3.5 and about 5.5 inches deep, whereby the first and second sides of the recessed portion are separated by about 1.5 inches, and the third side is displaced from respective first and second end portions of the mounting wall by about 3.5 to about 5.5 inches.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
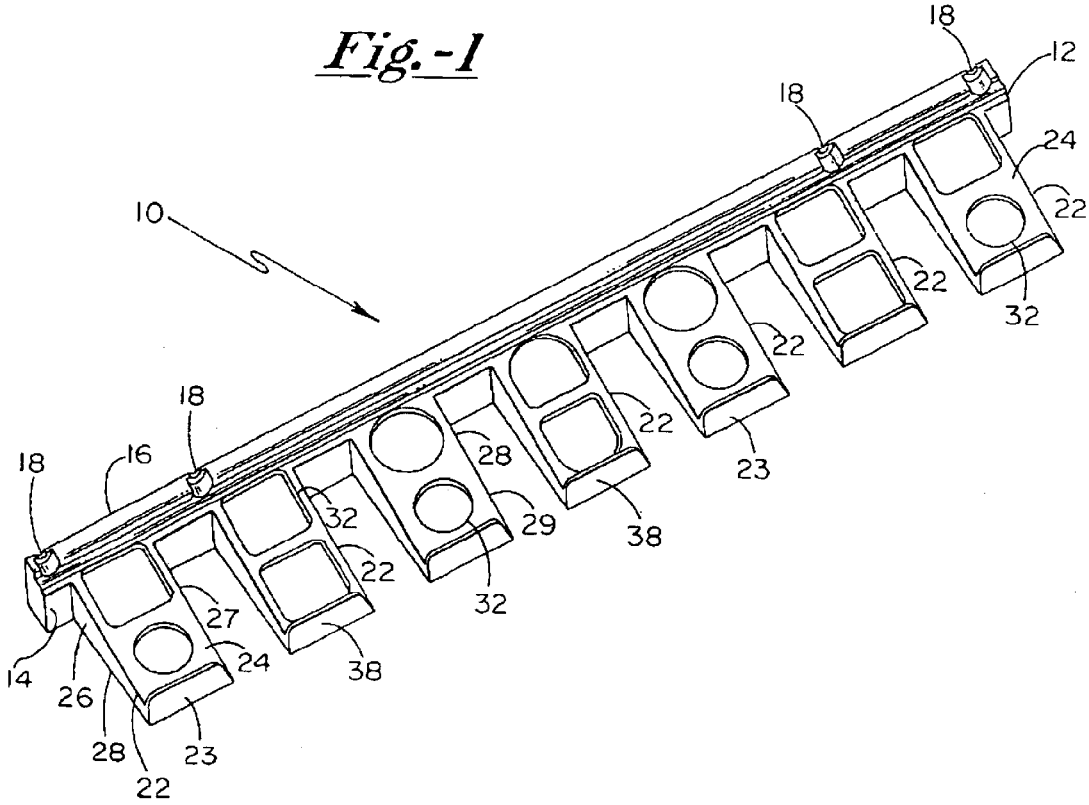
FIG. 1 is a perspective view of a storage device of the present invention.

Referring now by characters of reference to the drawings, and first to FIG. 1, a storage device 10 of the present invention is shown. As illustrated in FIG. 1, storage device 10 includes an elongated frame 12 having a first side 14 and a second side 16, which second side 16 operably bears against an upstanding surface when storage device 10 is secured to such an upstanding surface. To obtain such a removable securement of storage device 10 to an upstanding wall, mounting apertures 18 are disposed in frame 12, and preferably extend from first surface 14 to second surface 16. Preferably, mounting apertures 18 are sized and configured to receive fasteners such as screws and the like therethrough, such that frame 12 may be mounted flush against an upstanding surface such as a vertical wall.

As shown in FIG. 1, storage device 10 preferably includes a plurality of storage protrusions 22 extending outwardly from first surface 14 of frame 12. Protrusions 22 are preferably equally spaced along frame 12 so as to provide a minimum spacing between respective adjacently disposed implements stored in storage device 10. Protrusions 22 each preferably include a relatively flat upper surface 24 and opposing side surfaces 26, 27 depending downwardly therefrom. Such side surfaces 26, 27 provide structural support to protrusions 22, and are preferably tapered, such that an inner portion 28 of respective side surfaces 26, 27 is greater in height than corresponding outer portions 29. In other embodiments, however, respective side surfaces 26, 27 are uniform in height throughout the respective length thereof.

In preferred embodiments, respective upper surfaces 24 of protrusions 22 include one or more storage apertures 32 disposed therein for operably receiving handled implements therethrough. Storage apertures 32 are preferably specifically sized and configured to receive various handled implements therethrough. As illustrated in FIG. 1, a variety of configurations are provided for apertures 32, such that a variety of differently shaped handled implements may be received in respective storage apertures 32 of storage device 10. Examples of articles that may be desirably retained within storage apertures 32, and thus conveniently stored, include handled articles such as brooms, mops, shovels, hammers, and the like. Each storage aperture 32 includes a minimum gap sizing of at least about 0.25 inch.

As further illustrated in FIG. 1, protrusions 22 also preferably include tabs 38 extending upwardly from respective distal ends 23 of protrusions 22. Tabs 38 are preferably configured to provide a hook retention means for hanging items therefrom. Such tabs 38 are particularly useful in retaining items such as clothes, clothes hangers, towels, or the like.

Figure 2:
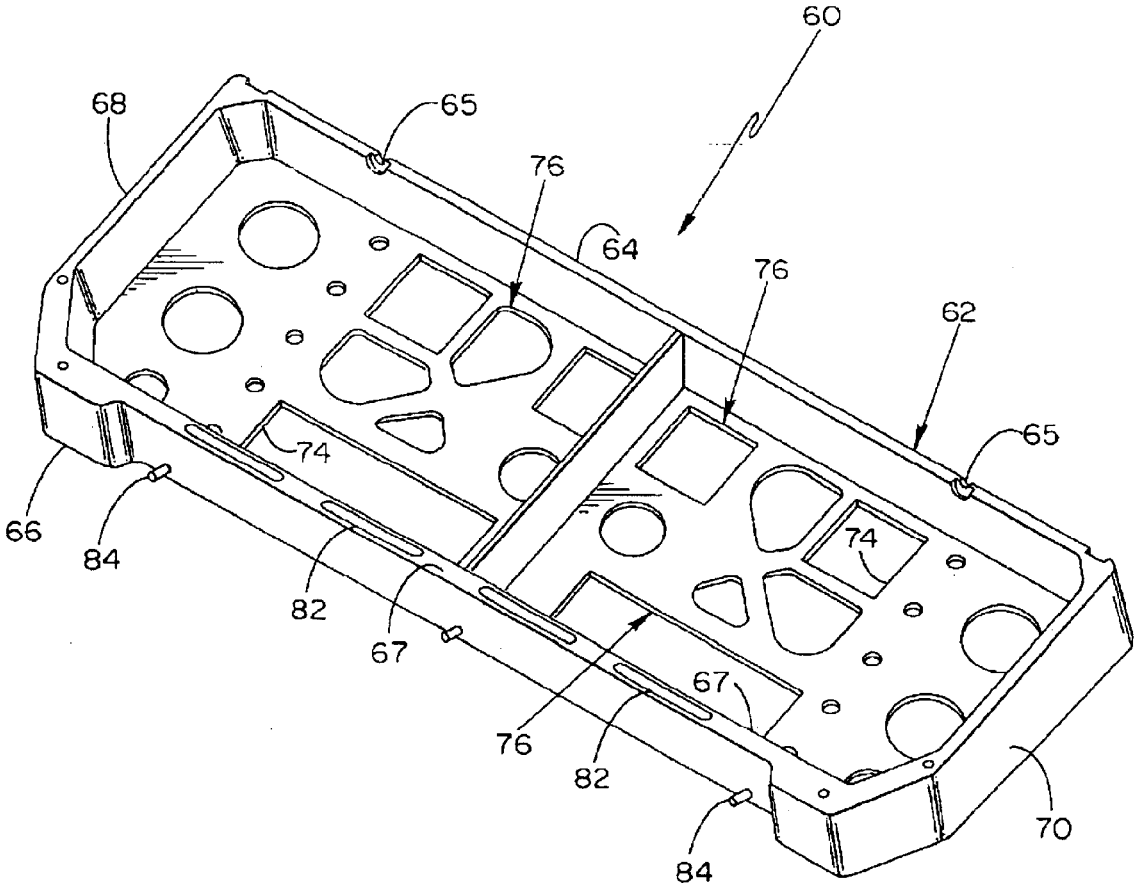
FIG. 2 is a perspective view of an alternative embodiment of the storage device of the present invention.

Another embodiment of the present invention is illustrated in FIG. 2, wherein a storage device 60 is shown including a frame 62 having a first side wall 64, a second side wall 66 which generally opposes first side wall 64, and respective first and second end walls 68, 70. Side walls 64, 66 and end walls 68, 70 preferably extend upwardly from a generally planar support surface 74 such that side walls 64, 66, end walls 68, 70 and support surface 74, in combination, define a storage enclosure thereby.

First side wall 64 of frame 62 preferably includes mounting apertures 65 disposed therein for operably receiving mounting fasteners therethrough for removably attaching frame 62 to an upstanding surface such as a vertical wall. In such a manner, fasteners (not shown) are preferably operably receiving through apertures 65 to removably secure first side wall 64 flushly against the upstanding wall.

As further illustrated in FIG. 2, storage device 60 preferably includes a plurality of storage apertures 76 disposed in support surface 74. Storage apertures 76 are preferably variously configured, and spaced substantially throughout support surface 74 for receiving various handled implements therethrough. Preferably, such apertures 76 are specifically configured to receive such handled implements.

Preferably, at least second side wall 66 includes a top surface 67 through which a plurality of storage slots 82 extend. Therefore, storage slots 82 preferably extend vertically through second side wall 66, and are specifically configured to receive relatively narrow handled implements, such as screwdrivers, pliers, or the like. Storage slots 82 may also be disposed in respective end walls 68, 70.

Second side wall 66 of frame 62 also preferably includes a plurality of hook tabs 84 extending outwardly therefrom. Hook tabs 84 are preferably configured for operably hanging items therefrom, including clothes, clothes hangers, strap devices, and the like. Hook tabs 84 preferably add to the overall versatility of storage device 60, and are not required to be included in preferred embodiments of the invention.

Figure 3:
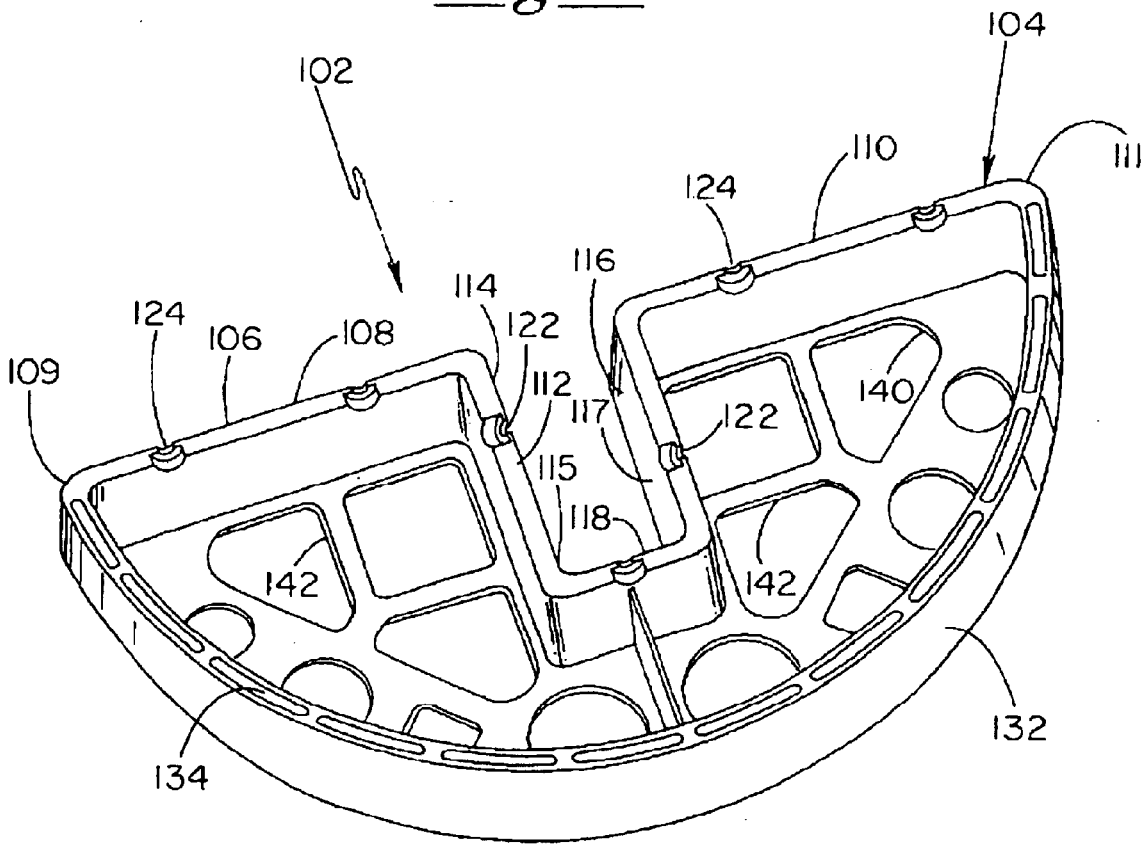
FIG. 3 is a perspective view of an alternative embodiment of the storage device of the present invention.

Another embodiment of the present invention is illustrated in FIG. 3. Storage device 102 includes a frame 104 having a mounting wall 106. Mounting wall 106 includes a first end portion 108, a second end portion 110, and a recessed portion 112 disposed between first and second end portions 108, 110. Recessed portion 112 preferably includes a first side 114, a second side 116, and a third side 118 extending between respective distal ends 115, 117 of first and second sides 114, 116. As shown in FIG. 3, first, second, third sides 114, 116, 118, of recessed portion 12 preferably include mounting apertures 122 disposed therein for operably receiving mounting fasteners therethrough. Such mounting apertures 122 are preferably located to provide frame 104 with sufficient support when fasteners such as screws are inserted into an upstanding structure disposed within recessed portion 112. Mounting apertures 124 are also preferably provided in respective first and second end portions 108, 110, whereby fasteners such as screws may be inserted therethrough into an upstanding surface such that storage device 102 may be substantially flush mounted against such upstanding surface.

As shown in FIG. 3, frame 104 further includes an outer wall 132 extending outwardly from, and connecting respective distal ends 109, 111 of respective first and second end portions 108, 110. Outer wall 132 is preferably semicircular, though a variety of other configurations for outer wall 132 are contemplated by the present invention. In preferred embodiments, however, outer wall 132 and mounting wall 106, in combination, form a perimeter between which is disposed a support surface 140. Preferably, support surface 140 extends between respective lower edges of mounting wall 106 and outer wall 132 to thereby form a recessed, or "trayed", structure of storage device 102.

In preferred embodiments of the present invention, support surface 140 includes a plurality of storage apertures 142 disposed therein. Preferably, such storage apertures 142 have a variety of different configurations specifically sized to receive various handled implements therethrough. In particular, the present invention is preferably utilized to operably receive a handle portion of a handled implement such as a shovel, broom, or the like vertically through respective storage apertures 142, to thereby efficiently store the respective handled implements.

Storage device 102 is preferably specifically configured to removably attach to upstanding walls having exposed studs thereon. Preferably, an exposed stud (not shown) is received within recessed portion 112 of storage device 102, while respective first and second end portions 108, 110 flushly abut the upstanding wall. Storage device 102 may then be removably attached to such an upstanding wall stud via mounting apertures 122. Wall mounting apertures 124 may also be utilized to further secure storage device 102 in position, though such use is not contemplated as being required. In the alternative, storage device 102 may be removably attached to an upstanding wall via mounting apertures 124 alone. In such a manner, storage device 102 need not be secured to a wall stud.

Storage device 102 is particularly useful in mounting to walls having exposed wall studs such as, for example, in an unfinished garage or basement. Storage device 102, therefore, maximizes use of unfinished wall space by utilizing upstanding wall studs as a supporting structure. As such, recessed portion 112 is preferably about 1.5 inches wide and between about 3.5 inches and about 5.5 inches deep. Thus, typically used 2×4 and 2×6 wall studs are conveniently received within recessed portion 112 of storage device 102. It is also contemplated in the present invention to alter the size of recessed portion 112 to accommodate differently sized wall studs. It is preferred, however, that recessed portion 112 substantially abuts the upstanding wall stud in applications where the wall stud is being utilized for structural support of storage device 102.

As further seen in FIG. 3, outer wall 132 preferably includes one or more storage slots 134 extending vertically therethrough, whereby such storage slots 134 are specifically configured to receive relatively narrow handled implements such as screw drivers and the like.

Figure 4:
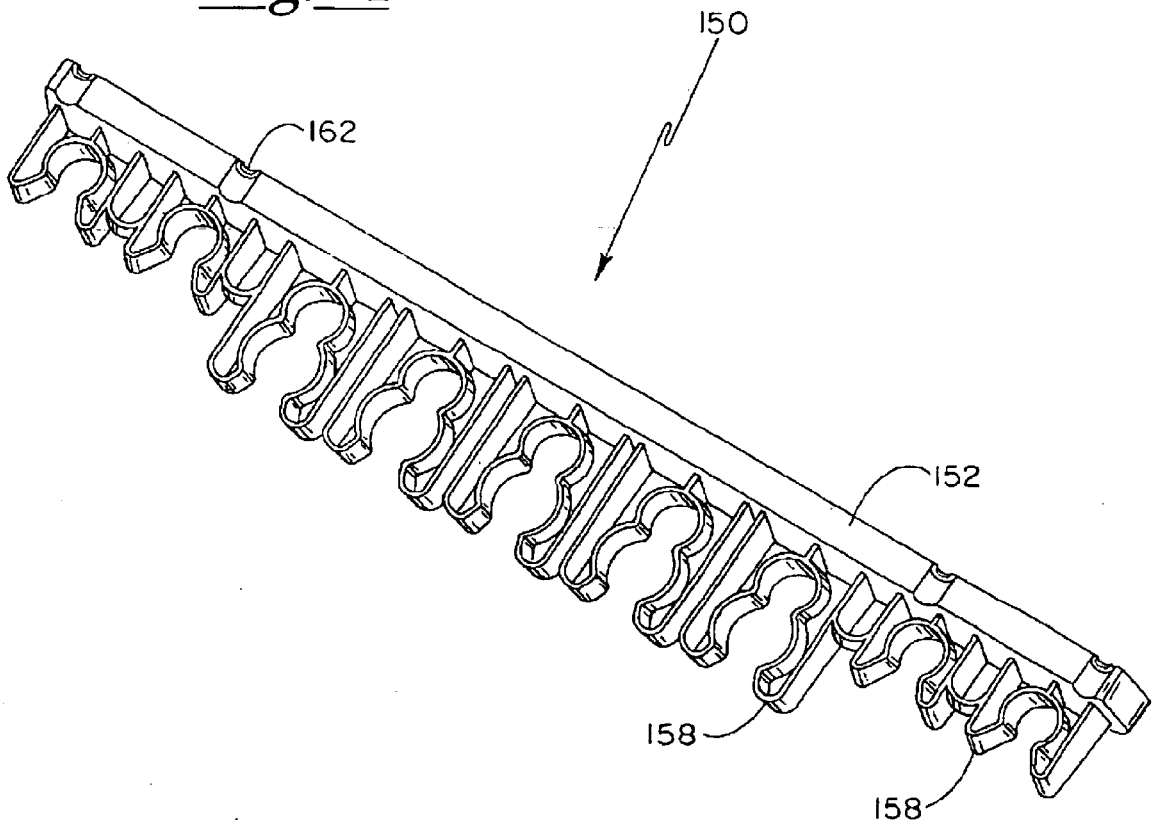
FIG. 4 is an alternative embodiment of the storage device of the present invention.

An additional embodiment of the present invention is illustrated in FIG. 4, wherein storage device 150 includes an elongated frame 152 and a plurality of mutually opposed clamp arms 158 extending therefrom. Opposing clamp arms 158 are preferably configured in respective pairs, such that opposing clamp arms 158 act to grip and retain the handles of respective handled implements therein. Preferably, clamp arms 158 are sufficiently resilient to tightly grasp such handled implements, and to suspend such handled implements above the ground. Frame arm 152 is preferably removably attached to an upstanding wall surface via fasteners extending through respective mounting apertures 162.

The described embodiments of the present invention are preferably fabricated from a polymeric material such as polypropylene, or the like. A particular advantage introduced by the storage device embodiments of the present invention is the ability to efficiently and compactly store a variety of handled implements adjacent to an upstanding wall surface. In particular, the present invention provides a means for efficiently suspending such handled implements above the ground surface and adjacent to an upstanding wall. In such a manner, a wide variety of items may be organized and stored in a compact space.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A storage device, comprising:

(a) an elongated frame having a first side and a generally opposing second side, said frame including mounting apertures disposed in said first side thereof for operably receiving mounting fasteners therethrough for removably attaching said frame to an upstanding surface; and (b) a plurality of storage protrusions integrally formed with one another and with said frame, and extending horizontally outwardly from said first side of said frame, said protrusions having a generally horizontal flat upper surface and opposing side surfaces depending downwardly therefrom, said protrusions each having a tab extending upwardly from respective distal ends thereof, said protrusions being spaced apart along an entire length of said frame so as to form individual support bodies integrally connected with one another, respective said upper surfaces of said storage protrusions each including a plurality of storage apertures disposed therein, whereby the apertures are each distinctly defined in respective said upper surfaces of respective said storage protrusions, and are specifically sized and configured to operably receive handled implements therethrough.

* * * * *